US007341314B1

(12) United States Patent
Boyd

(10) Patent No.: US 7,341,314 B1
(45) Date of Patent: Mar. 11, 2008

(54) SPORTS SAFETY DEVICE

(76) Inventor: Ray Boyd, 701 County Rd. 602, Enterprise, AL (US) 36330

( * ) Notice: Subject to any disclaimer, the term of this patent is extended or adjusted under 35 U.S.C. 154(b) by 343 days.

(21) Appl. No.: 11/127,070

(22) Filed: May 12, 2005

(51) Int. Cl.
*A47C 9/10* (2006.01)

(52) U.S. Cl. ..... 297/467; 297/188.09

(58) Field of Classification Search ..... 297/188.08, 297/188.09, 188.12, 188.13, 467
See application file for complete search history.

(56) References Cited

U.S. PATENT DOCUMENTS 2,127,020 A * 8/1938 Carlson ..... 297/423.19
3,306,658 A * 2/1967 Roberts ..... 297/4
3,992,057 A * 11/1976 Studebaker ..... 297/467
4,295,680 A * 10/1981 Grasso ..... 297/188.09
4,969,689 A * 11/1990 Kricheldorf ..... 297/467
5,137,334 A * 8/1992 Cheney et al. ..... 297/467
5,170,516 A * 12/1992 Davison ..... 4/484
5,427,426 A * 6/1995 Grappo ..... 297/212
5,490,717 A * 2/1996 Greene ..... 297/452.41
5,586,805 A 12/1996 Rinehart
5,802,760 A 9/1998 Campbell
6,309,022 B1 * 10/2001 Melgarejo et al. ..... 297/467
D450,943 S 11/2001 Bell
6,431,645 B2 * 8/2002 Massara et al. ..... 297/144

* cited by examiner

*Primary Examiner*—Peter R. Brown
(74) *Attorney, Agent, or Firm*—Harpman & Harpman

(57) ABSTRACT

A lightweight interchangeable shield device to protect and prevent injury to individuals involved in baseball related sports activity. The shield device extends integrally from a seat between the legs of the individual protecting the crotch region from being hit with a baseball during practice. The seat can be configured as a closure lid for upright containers having an open end or can be of a contoured cushion configuration. The shield is adaptable to conform to other seat structures independently.

5 Claims, 7 Drawing Sheets

SPORTS SAFETY DEVICE

BACKGROUND OF THE INVENTION

1. Technical Field

This device relates to safety sports equipment to prevent groin region injuries to individuals during practice, specifically for baseball or softball catchers. During practice a coach or player often acts as a catcher for their pitcher using any sort of stool or small seat available including a five gallon bucket to sit on for a long period of time.

2. Description of Prior Art

A variety of safety equipment has been developed for use in practicing and playing baseball or softball. Typically a catcher has a face mask, shin guards and upper body protection. Additional crotch protection referred to as "cups" are available as athletic supports to protect male players genitalia from injury, such athletic "cups" are typically uncomfortable and inconvenient to put on or take off especially with girl teams. A number of sport related seats have been developed in which storage containers have integrated seat areas for sportsman activities such as fishing, see U.S. Pat. No. 5,802,760 as well as a portable combination seat and container disclosed in U.S. Pat. No. 5,586,805. Specialized seating for baseball or softball has also been developed to be used during practice, see for example U.S. Pat. D450,943 which illustrates a stool mounted on a spring base.

SUMMARY OF THE INVENTION

The present invention provides a safety shield for temporary practice seats of the type used for recreational purposes, during baseball or softball practice. To serve the purpose of an athletic "cup", the safety shield includes a contoured upstanding panel having a contoured surface, top and side depending edges and is adapted to be an integral part or removable attachment to the rim area of a seating surface. Such integral attachment adaptability can be used on closures for containers used for temporary seating during practice and other contoured independent seating surfaces so used. The safety shield is positioned to extend up between the legs of a seated individual protecting the crotch and groin area from impact by an errant baseball or softball during practice while not encumbering the catcher.

DETAILED DESCRIPTION OF THE INVENTION

Figure 1:
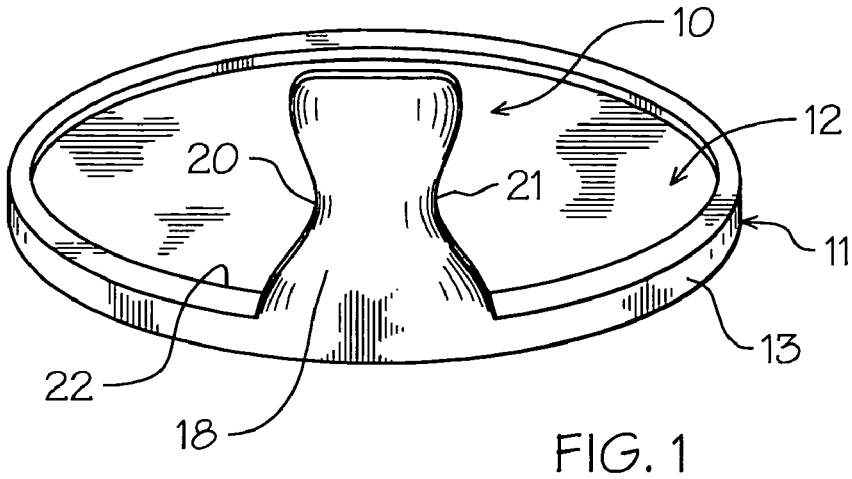
FIG. 1 is a perspective view of the safety shield of the present invention on a closure seat lid.
Figure 2:
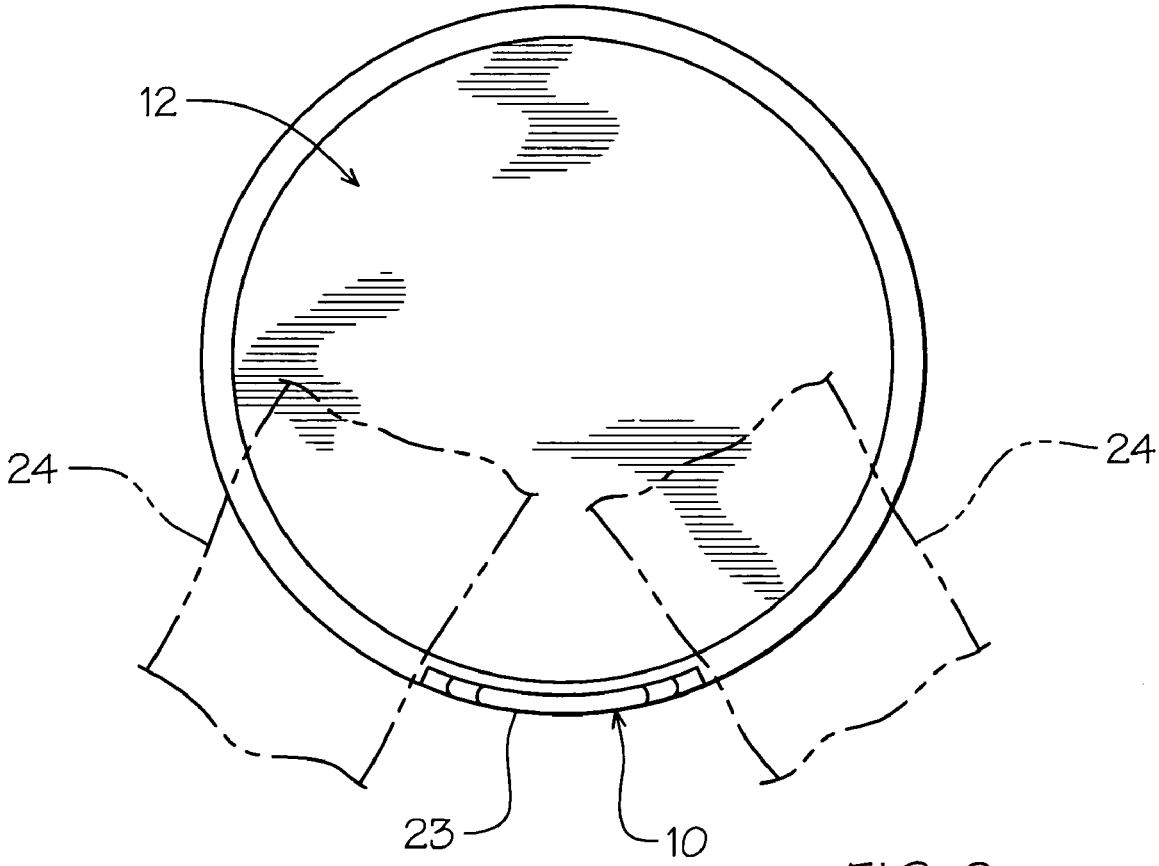
FIG. 2 is a top plan view thereof.

Referring to FIGS. 1-4 of the drawings, an integrated safety seat shield device 10 can be seen in which an annular seat lid 11 having a seat surface 12 and a depending annular sidewall lip 13 is shown for use on a utility container or the like. The seat lid 11 is preferably of molded synthetic resin material and is configured with the sidewall lipi 3 enclosing a well known lip engagement configuration 14 to registerably fit onto the corresponding container's upper rim 15 defining an open end 16 of a container 17 such as a five gallon plastic bucket illustrated in this example in FIG. 3 of the drawings.

The seat shield 10 of the invention is of an upstanding integral contoured body member panel 18 with in this example a mid-area of reduced transverse dimension at 19. Contoured oppositely disposed spaced side edges 20 and 21 extend to and are integral with an upper surface 22 of the lip configuration 13. The seat shield 10 extends annularly from around a portion 23 of the lip configuration 13 sufficient to allow user's legs 24 shown in broken lines in FIG. 2 of the drawings to straddle thereabout as would occur in normal seating position indicative of a legs apart position as shown.

The seat shield 10 is of a height generally equal to its transverse width at its intersection with the hereinbefore described sidewall lip portion 13. The area of reduced transverse dimension at 19 will accommodate the user's legs 24 so as to provide a more form fitting dimensional cover over the crotch area when, as noted, in a sitting position protecting the user from injuries in that sensitive region.

Figure 3:
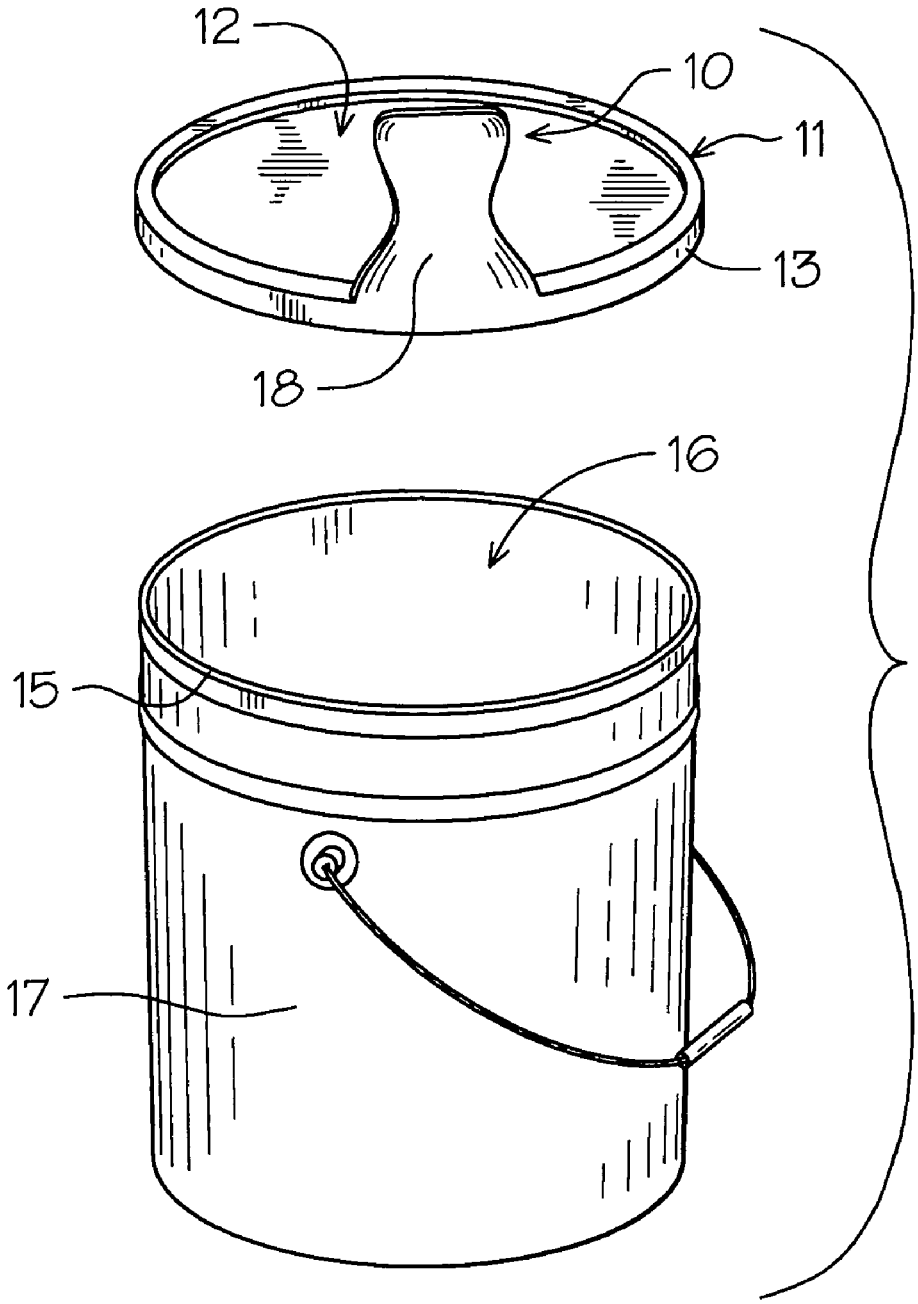
FIG. 3 is an exploded perspective view of the seat shield closure seat lid and support bucket for registration therewith.
Figure 4:
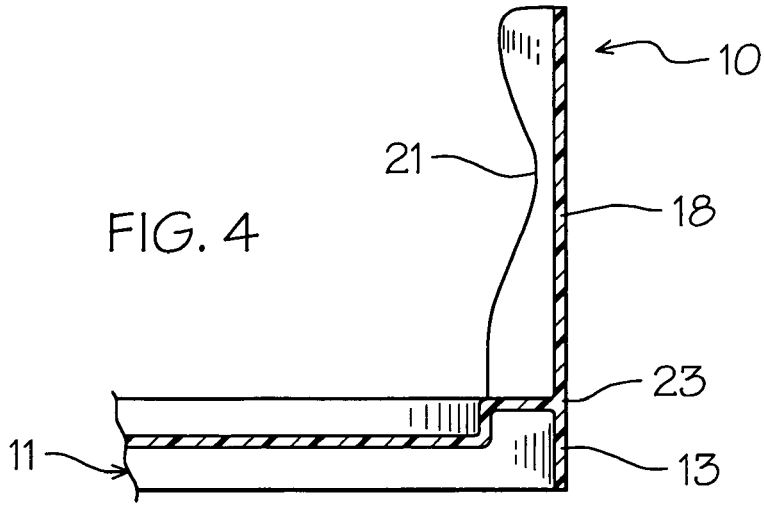
FIG. 4 is a partial sectional view of the seat shield and closure seat lid.

The application of the integral safety seat shield 10 with the seat lid 11 will provide for a single one-piece assembly for registerable engagement with the hereinbefore disclosed bucket container 17 as seen in FIG. 3 of the drawings.

Figure 5:
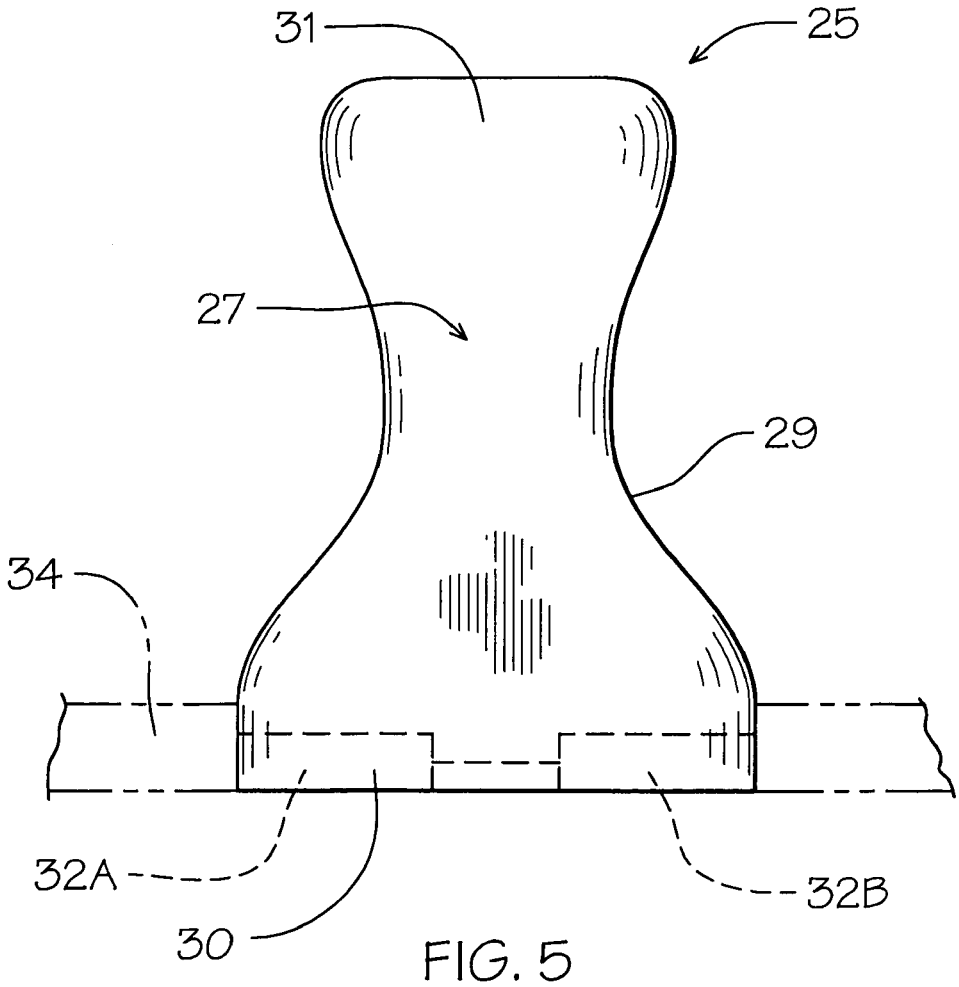
FIG. 5 is a front elevational view of a first alternate detachable form of the invention.
Figure 6:
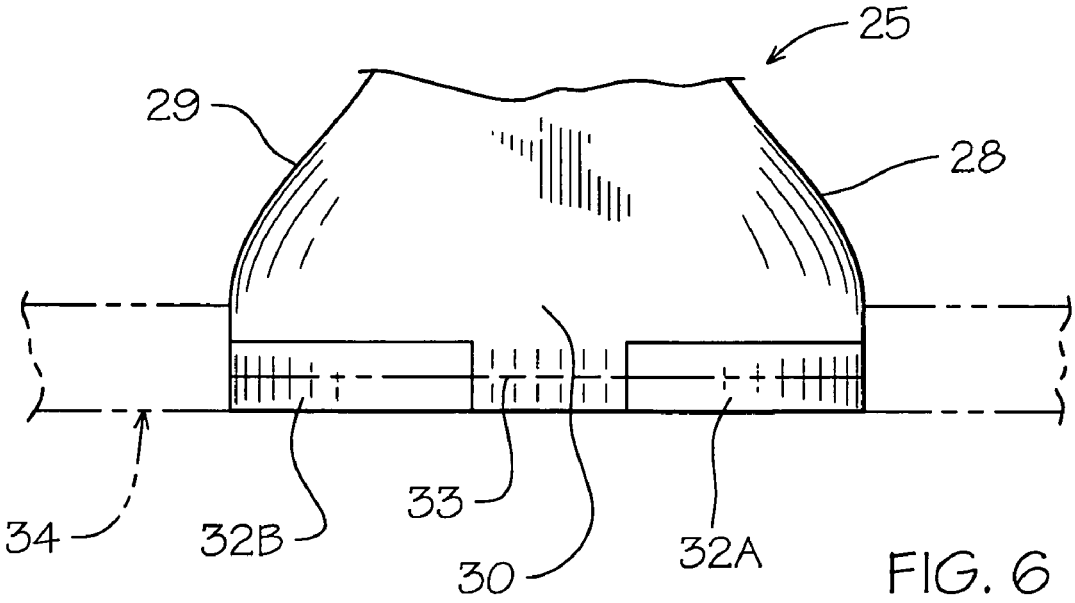
FIG. 6 is a rear elevational view thereof with portions broken away.
Figure 7:
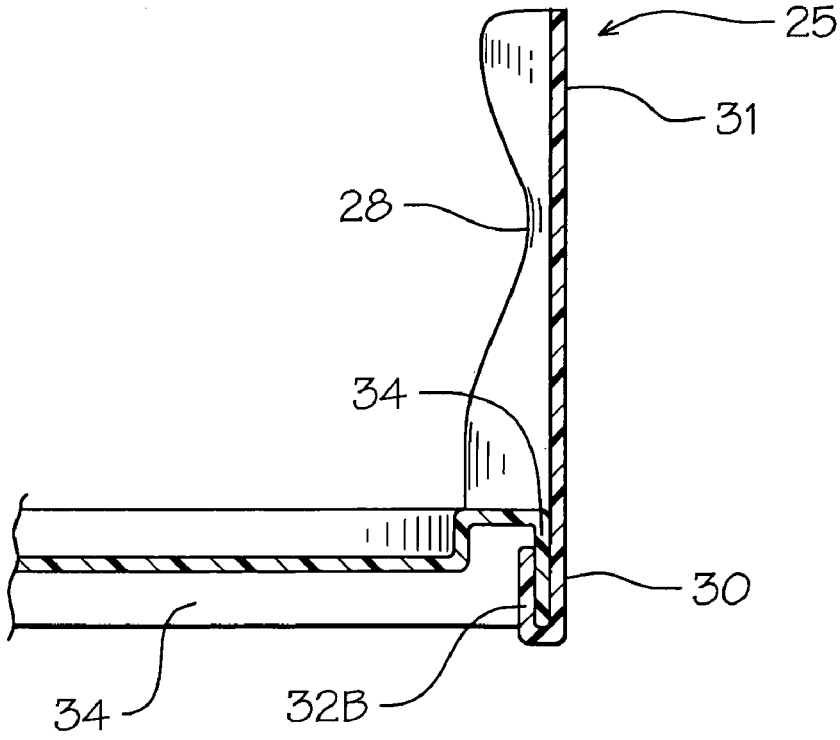
FIG. 7 is a partial sectional view thereof.

Referring now to FIGS. 5-7 of the drawings, a selectively, engageable and detachable seat shield 25 can be seen having an upstanding contoured curved main body member 26 with a mid-area of reduced transverse dimension at 27 and oppositely disposed contoured side edges 28 and 29 defining a lower base portion 30 and an upper end portion 31. The base 30 has a pair of elongated engagement tabs 32A and 32B extending back and upwards in spaced relation to the main body member 26 as best seen in FIG. 6 of the drawings and in dotted lines in FIG. 5 of the drawings.

An optional registration ridge at 33 on the surface of the body member 26 is in spaced overlap relation to the representative tabs 32A and 32B and acts in unison therewith to secure the seat shield 26 onto a descending wall 34 of a bucket lid shown in broken lines in FIG. 6 of the drawings and in solid lines in section in FIG. 5 of the drawings.

It will be evident from the above description that the tabs 32A and 32B may be modified to accommodate non-standard bucket closures using alternate engagement structures well within the province of those skilled within the art.

Figure 8:
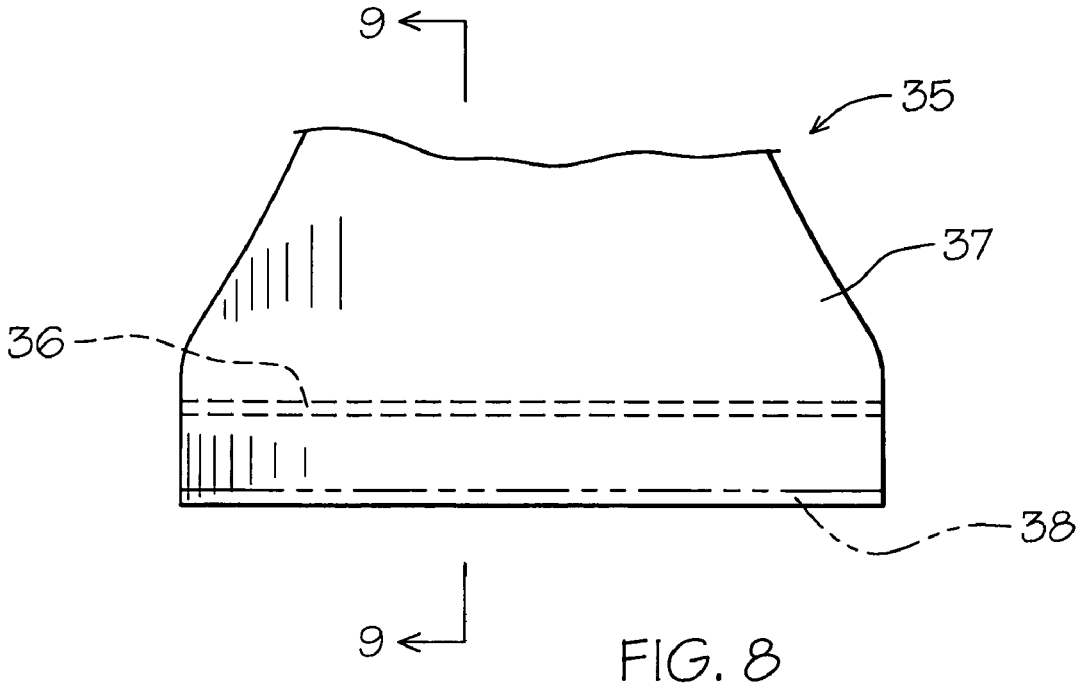
FIG. 8 is a partial front elevational view of an alternate form of the detachable form of the invention with a universal mounting flange.
Figure 9:
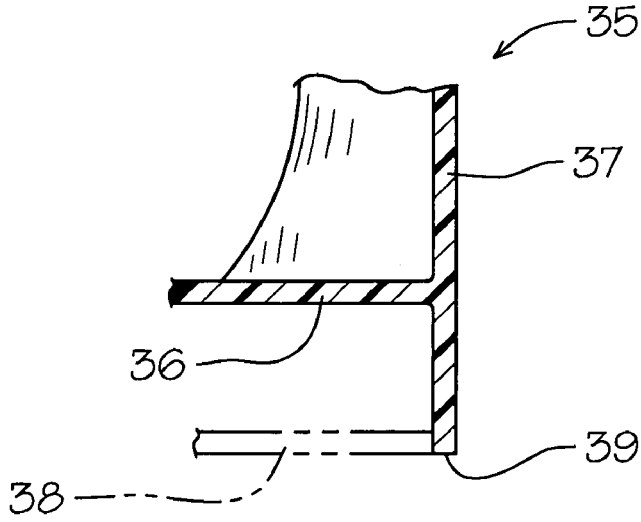
FIG. 9 is a cross-section on lines 9-9 of FIG. 8.
Figure 10:
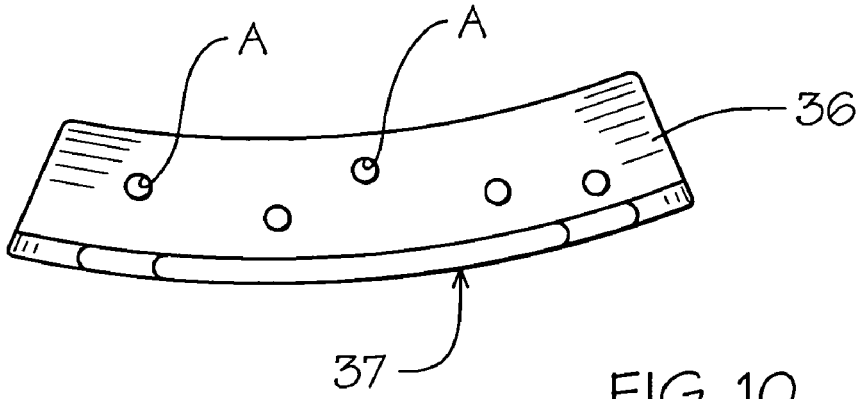
FIG. 10 is a top plan view thereof.

Referring now to FIGS. 8-10 of the drawings, an alternate mounting configuration can be seen in a seat shield 35 wherein the tabs 32A and 32B have been replaced by a mounting flange 36 extends at right angles to a main body member 37 thereof. This mounting flange 36 preferably has a plurality of apertures A therein as best seen in FIG. 10 of the drawings to affect multiple means for securing the same to different seat surfaces. Alternately, the mounting flange 36 can extend from a bottom free end edge 39 of the body member 21 as shown in broken lines in FIGS. 8 and 9 of the drawings at 38 providing additional mounting apertures to the seat configuration (not shown).

Figure 11:
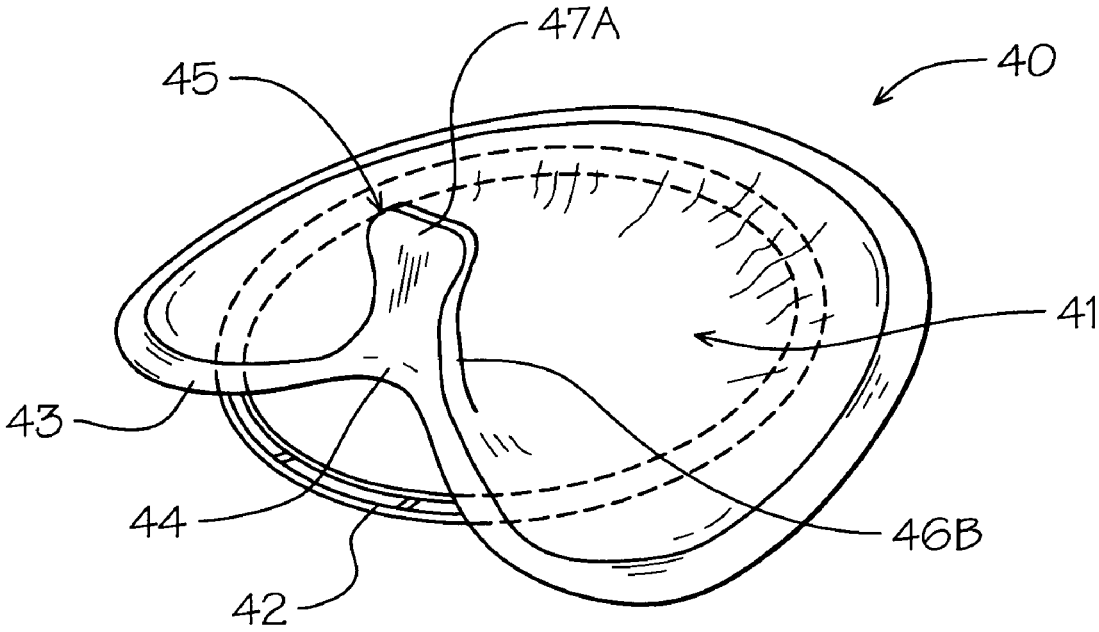
FIG. 11 is a perspective view of a second alternate form of the invention with an integrated seat adapted for support contour.
Figure 12:
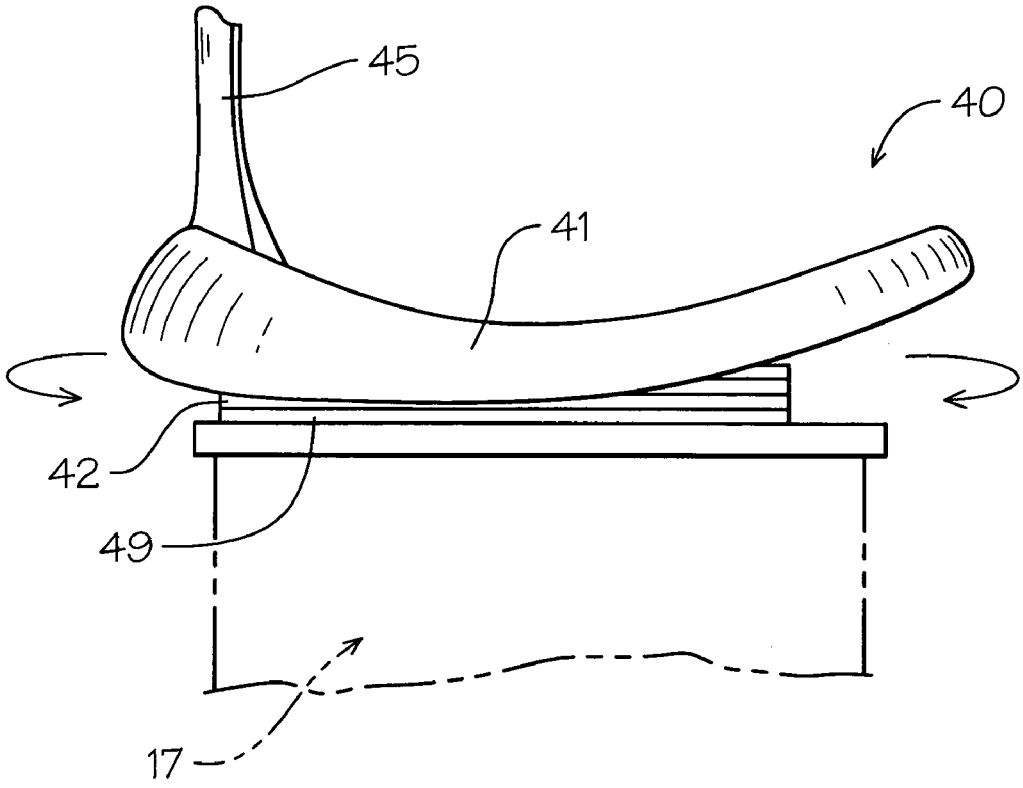
FIG. 12 is a side elevational view thereof having a swivel base adapter thereon.

A combined contoured seat closure 40 can be seen in FIG. 11 of the drawings wherein a contoured seat element 41 has an annular bucket engagement base 42. The seat element 41 has a curvilinear front end edge 43 with an upturned center area 44 with an integral upstanding seat shield 45 extending therefrom. The seat shield 45 has contoured sides 46A and 46B with corresponding areas of increased transverse dimension at 47A to provide the maximum protection to the user's crotch area (not shown). A modified rotatable form of the combined seat and closure 48 is illustrated in FIG. 12 of the drawing in which a swivel assembly 49 is interdisposed between the seat element 41 and the bucket engagement base 42. The swivel assembly 49 is of a non-proprietary design well known within the art and allows for the contoured seat 41 and modified integral seat shield 45 of the invention to be swiveled 360 degrees in relation to the bucket engagement base 50 shown in broken lines.

It will be apparent to those skilled in the art that both the conventional seat and closure 40 and modified rotatable combined seat enclosure 48 may be adapted to other support structures independently of the support storage enclosure illustrated in broken lines in FIG. 12 of the drawings.

As noted, in use, a user would straddle the seat shield 10, 25, 35 and 40 of the invention in any of the alternate forms hereinbefore described while repeatedly catching a baseball which is common during practice while coaching, for example. The seat shield 10, 25, 35 and 40 will protect the user from painful injuries to the crotch area by missed or improperly caught balls thrown by co-participants (not shown).

Thus, it will be seen that a new and useful seat shield has been illustrated and described and it will be apparent to those skilled in the art that various changes and modifications may be made therein without departing from the spirit of the invention.

Therefore I claim:

1. A safety device used in association with a sports seat having a continuous upturned sidewall lip of a known distance for sitting comprises, a contoured upstanding shield panel extending from a front edge of the seat, said contoured shield panel having a base portion integral with the front edge of the seat, said shield panel having curved oppositely disposed side edges defining an area of reduced transverse dimension therebetween, said base portion extending along the front edge of the seat a known distance between a user's legs when seated on said seat, said shield panel extending from said seat a distance greater than said known distance of said upturned sidewall lip of said seat, said sport shield panel positioned between the user's legs from said seat to protect the user's crotch area defined therebetween.

2. The sports safety device set forth in claim 1 wherein said seat comprises a closure and said shield is integral therewith.

3. The sports safety device set forth in claim 1 wherein said contoured upstanding shield panel is curved transversely to match the contours of the seat at its intersection therewith.

4. The sports safety device set forth in claim 1 wherein said contoured seat has a rotatable mounting base extending therefrom on an elevated support surface element.

5. The sports safety device set forth in claim 4 wherein said elevated support surface element comprises an bucket pail.

* * * * *